United States Patent [19]

Ganter

[11] 4,415,277

[45] Nov. 15, 1983

[54] TIME ADJUSTING MECHANISM FOR AN ELECTRONIC WRISTWATCH WITH A MANUAL ADJUSTING STEM

[75] Inventor: Wolfgang Ganter, Schramberg, Fed. Rep. of Germany

[73] Assignee: Gebruder Junghans GmbH, Schramberg, Fed. Rep. of Germany

[21] Appl. No.: 360,922

[22] Filed: Mar. 23, 1982

[30] Foreign Application Priority Data

Apr. 1, 1981 [DE] Fed. Rep. of Germany ..... 3113019

[51] Int. Cl.[3] ..... G04B 27/02

[52] U.S. Cl. ..... 368/190

[58] Field of Search ..... 368/69–71, 368/80, 185, 190–199, 308, 319–320

[56] References Cited

U.S. PATENT DOCUMENTS

| | | | |
|---|---|---|---|
| 3,827,235 | 8/1974 | Bachmann | 368/190 |
| 4,104,866 | 8/1978 | Chapatte | 368/319 |
| 4,362,391 | 12/1982 | King et al. | 368/69 X |

*Primary Examiner*—Vit W. Miska

*Attorney, Agent, or Firm*—Burns, Doane, Swecker & Mathis

[57] ABSTRACT

In an electronic writswatch a hands mechanism is adjusted manually by a pull-out stem. When the stem is pulled out, it displaces a correction wheel to operatively connect the stem with the hands mechanism. The correction wheel is moved tiltingly so that only a force-transmission side thereof (adjacent the hands mechanism) is raised and lowered. The opposite side of the correction wheel serves as a fulcrum for such tilting motion. The force-transmission side thus moves within a chamber conventionally provided in the hands mechanism and thus minimizes the height of the watch.

9 Claims, 4 Drawing Figures

TIME ADJUSTING MECHANISM FOR AN ELECTRONIC WRISTWATCH WITH A MANUAL ADJUSTING STEM

BACKGROUND AND OBJECTS OF THE INVENTION

The invention relates to a time adjusting mechanism in an electronic wristwatch of the type having a setting shaft which is moved into and from operative connection with a correction wheel.

An adjusting mechanism of this type is known from DE-AS No. 29 47 400. It is characterized by a relatively simple configuration, because the drive of the time indicator hands is effected through a quartz-stabilized, electronically actuated stepping motor. That is, the setting shaft does not have to be structured and arranged to wind a force accumulator (i.e., a clockwork spring).

Such a known time adjusting mechanism possesses considerable advantages with respect to the simple layout and functionally safe actuation of a manual calender setting (which in the present adjusting mechanism for a wristwatch without a calendar display is not required). However, it also has the disadvantage that accessibility of the setting shaft to the hands mechanism for the manual setting of the hands is cumbersome in view of the structural parts required and the space needed within the mechanism for their operation. A particular disadvantage involves the need for a considerable open area for accommodating the correction wheel when the latter is displaced between its inoperative and adjusting positions in response to axial sliding of the setting stem or shaft. The provision of such space is contrary to the desire for a flat wristwatch configuration.

Concerning the requirements of a flat configuration and small dimensions of wristwatches, no significant improvement is obtained by using, in place of the correction wheel height control, a set wheel arranged coaxially in the area of the tip of the setting shaft and equipped with crown gearing. For the operationally effective functioning of such a gearing (the teeth of which are bent transversely with respect to the wheel), a large wheel diameter extending in height (i.e, parallel to the hands axis) is required. Also, such wheel must be placed in an area close to the center of the works, contrary to the goal of placing gears as close to the shaft as possible in order to reduce the structural height. Furthermore, a lateral (i.e., directed radially with respect to the axis of hands rotation) spring pressure would be necessary for maintaining the correction position, which is not comparible with the mode of operation of the commonly used automatic assembly installations for wristwatch mechanisms; such installations are, rather, based for operational reasons on an installation sequence in the direction of the axis of the mechanism.

Finally, it is possible, in particular in order to obtain a flat configuration wherein an actuation in the upward direction is fundamentally detrimental, to convert the axial displacement of the setting shaft into a correction position by way of a setting lever gear located under the setting shaft into a meshing displacement of the correction wheel parallel to the plane of the gears of the mechanism. This translation movement requires, however, long lever arms and, again, springs acting transversely to the works axis, together with a large number of cooperating individual parts; the components and their installation would require approximately one-fourth of the entire available surface, i.e., a quadrant adjacent to the setting shaft. This would require an expansion in either the height or surface area of the watch to house further operating parts, such as the electronic circuit, the surface area of the mechanism must be enlarged. To this is added the higher cost of the production, storage, installation and possibly the replacement during repairs of the numerous individual parts.

In view of these conditions, it is an object of the present invention to provide a time adjusting mechanism with a setting shaft of the above-described generic type, characterized by (i) a high operating safety, (ii) a minimal structural height of the works, and (iii) reduced manufacturing and installation efforts.

SUMMARY OF THE INVENTION

These objects are attained according to the invention which involves an electronic wristwatch in which a rotatable correction wheel is moved into and from operative gearing connection with a hands mechanism by means of an axially slidable setting shaft. The positioning of the correction wheel is determined as a function of the axial placement of the shaft. The correction wheel is mounted for tilting movement such that the axis of rotation of the wheel is inclined in a manner moving a forced transmission portion of the wheel into and out of gearing connection with the hands mechanism in a direction generally parallel to the hands axis.

This arrangement is distinguished particularly in that the operational and spatial advantages of the actuation in height of the correction wheel engagement are achieved, without requiring the addition of height for this function of the engagement of the correction wheel in the layout of the mechanism. Only one area of the correction wheel is being raised, i.e., in a location where space is available through the adjacent gear chamber. An intermediate gear to drive the correction wheel may thus have a small diameter, even though it is extending along the height of the mechanism, i.e., parallel to the rotational axis of the works and the hands, since its teeth are extended in the radial direction (in contrast to the axial direction of the above-mentioned crown gear) and are located adjacent to the entry of the setting shaft into the works, where heights are not restricted by the mechanism of the hands. In the direction of the setting shaft and closely above it, it is followed by the other gear part for the correcting engagement, the correction wheel, whereby the distance to the hands mechanism in the center area of the works is being bridged. Only in the lifting direction and thus in the direction of the axis of the arbor of the hands, is it necessary to apply spring pressure to moving parts; this conforms to the operating mode typical of the automatic works assembly installations. Since, as the result of the oblique position of the correction wheel, the lifting of its gearing engagement takes place only in the area of the hands mechanism (and thus within the free space already provided for the gear mechanism of the hands), the diametrically opposed part of the correction wheel (oriented toward the edge of the watch mechanism) which directly engages the intermediate contrate gear, is pressed against the block and leaves space on the block for the mounting of spring plates and the engagement of a watch face holder.

The transition from the correction position into the operating mode or vice versa, i.e., the actuation or release of the engagement of the correction wheel and the minute wheel is effected without affecting the instantaneous position of the hands. In the operational setting, no gear part other than the already existing hands mechanism must be driven.

Preferably, the correction wheel includes a central bearing journal. The wheel is mounted by means of a mounting block having an aperture within which the bearing journal is disposed. A spring is arranged to bias the bearing journal against the shaft. The shaft has axially spaced control surfaces of different radial height to determine the position of the bearing journal and the forced transmission portion of the wheel. An intermediate gear is arranged for being rotated by the shaft. The intermediate gear is operably connected to the correction wheel at a drive location diametrically opposite the forced transmission portion of the correction wheel. The aperture receives the bearing journal for relative play to enable the correction wheel to tilt generally about such drive location as a fulcrum.

Preferably, the spring comprises a leaf-spring anchored to the mounting block. The use of a leaf-spring is advantageous, because the spring can be employed to perform other functions, such as retaining the intermediate shaft in position. In this regard, the intermediate gear is preferably seated on the shaft and is disposed in a slot of the mounting block which prevents movement of the intermediate gear in the axial direction of the shaft. The shaft is slidable in the axial direction relative to the intermediate gear. The intermediate gear is restrained against lateral movement by a circuit board on one side and the spring on another side.

Preferably, spring means is provided for releasably retaining the shaft in a plurality of axial positions. If desired, such spring means could comprise part of the leaf-spring.

Preferably, the control surfaces of the shaft constitute portions of axially spaced locking grooves. The bearing journal engages the locking grooves to releasably retain the shaft in the axial positions. The spring means which retains the shaft in the plurality of axial positions is defined by the leaf-spring. Therefore, the bearing journal which functions to transmit forces to the correction gear for lifting the latter out of driving engagement with the hands mechanism, also performs the function of locking the setting shaft in its various axial positions.

Preferably, the leaf-spring is arranged to constitute the sole support for the correction wheel in the axial and radial directions of the latter. Again, the leaf-spring performs an additional function in addition to its biasing role.

THE DRAWING

Further characteristic and advantages of the invention will become apparent from the description hereinafter of two preferred embodiments of the invention represented in the drawing. In the drawing.

DETAILED DESCRIPTION OF PREFERRED EMBODIMENTS OF THE INVENTION

Figure 1:
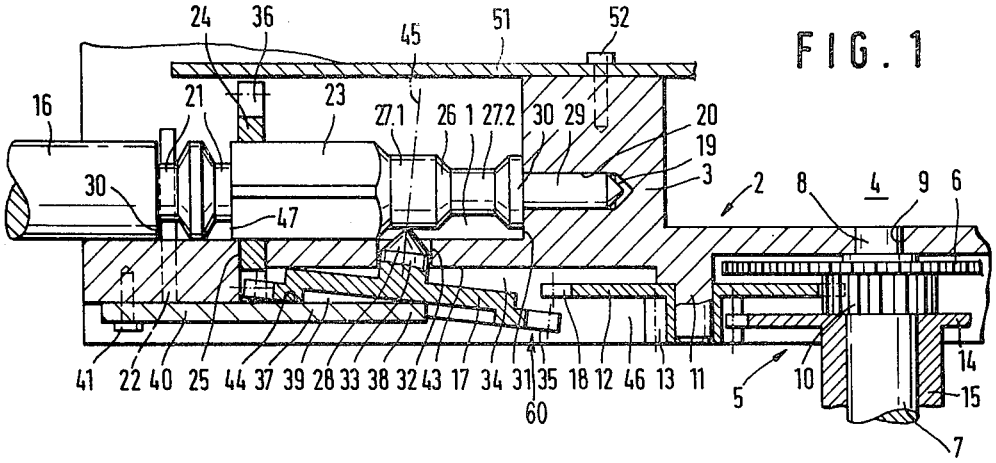
FIG. 1 shows an axial cross-section through a section of a mechanism of a wristwatch with an adjusting device according to one preferred embodiment of the invention, through the axis of the setting shaft showing the locking of the setting shaft in its operating (non-correction) position.

The setting shaft adjustment mechanism 1 shown in FIG. 1 is a component of the clockwork 2 of a flat, small diameter, electronic and preferably quartz-controlled wrist-watch. In a mounting block 3 of the mechanism 2, on the rear side (shown on top in the drawing) drive chambers 4 are provided for a battery and the installation of a stepping motor (not shown) for the activation of a hands mechanism 5. In the example of embodiment shown, the hands mechanism is not equipped to drive a second hand. Rather, the rotor of the stepping motor drives, by means of gears containing an intermediate wheel (not shown), a minute gear 6 (for either a time display with a so-called jumping minute hand, or more frequently, a display of time by means of an at least semi-continuously moving minute hand). A minute arbor 7 is connected fixedly in rotation with the minute gear 6. The minute arbor is of a hollow configuration if a second hand is to be installed. On its end passing through the face of the watch (at the bottom of the drawing, but not shown), the minute arbor carries the minute hand (not shown). An arbor butt 8 is formed on the rear end of the minute arbor 6, fitting into a bearing bore 9, axially supporting and radially guiding the minute arbor 7. In the hands mechanism 5, the minute gear 6 is coupled in rotation with an hour gear 14 by means of its minute gear pinion 10 and a minute wheel 12 support on a journal 11 on the block 3 and a minute wheel pinion 13. The hour gear 14 is equipped with an hour tube 15 and is supported on the minute arbor 7. The hour tube 15 also penetrates through the watch face (not shown), in order to carry the hour hand (not shown).

During the normal operation of a watch with a mechanism 2 of this type, its setting shaft 16, the free end (not shown) whereof penetrates through the case of the watch (not shown) and which is equipped for manipulation with a setting crown (not shown), is in the depressed or operating position shown in FIG. 1. A correction wheel 17, as explained in detail hereinbelow, is held out of engagement with a gear of the hands mechanism 5. The hands mechanism 5 is thus driven solely by the stepping motor (not shown).

Figure 2:
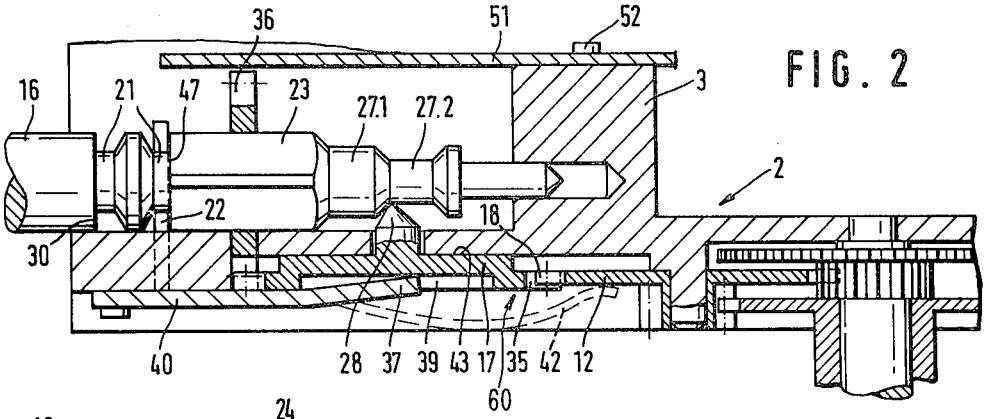
FIG. 2 shows the adjusting mechanism according to FIG. 1 with the setting shaft in the correction position.

An inner end 19 of a guide portion 29 of the setting shaft 16 is slidingly guided in a blind core 20 in the block 3. The shaft 16 includes two circumferential locking grooves 21 which are axially spaced from each other. The grooves 21 are entered under pressure by a locking element 22 resiliently attached to the block 3. The element 22 thus is in the form of a tangentially applied rod which releasably holds the setting shaft 16 in the operating mode (FIG. 1), or in the correction position (FIG. 2). These two functional positions are thus defined by the axial distance between the two locking grooves 21.

In a further area of the setting shaft 16, a polygonal shape 23 is formed, carrying an intermediate gear 24 which slidingly and coaxially receives the setting shaft 16, i.e., the intermediate gear 24 is coupled to the shaft 16 for rotation therewith by means of the polygonal shape 23, but is axially immobilized by means of its engagement in a slot 25 in the block 3. Thus, the shaft 16 moves axially relative to the gear 24 into its different functional positions.

At another location of the setting shaft 16, two cylindrical height adjustment surfaces 27.1, 27.2 with different diameters are formed for the control of the operative interconnection between the correction wheel 17 and the minute wheel 18. The surfaces are axially spaced from each other and are interconnected by means of a leading ramp 26 in the shape of a cone frustrum. A height control key 28 of the correction wheel 17 is elastically pressured toward each control surfaces 27.1, 27.2 (depending upon the instantaneous position of the setting shaft 16) in a direction which is radial with respect to the setting shaft 16. Between the guide end 29 and the adjacent shaft height control surface 27.2 of the shaft 16, a stop 30 is provided in the form of a circumferential flange or the like. Upon the depression of the setting shaft 16 in the operating position (FIG. 1) this stop 30 is urged against a wall 31 surrounding the blind bore 20. In palce of this arrangement, or in addition to it, the corresponding axial wall of the groove 21 may serve as the stop 30.

The mounting block 3 contains an aperture 32 above (below in the drawing) the area wherein the two control surfaces 27.1, 27.2 are located. The passage bore 32 constitutes a radial bearing support for the correction wheel 17, the latter being essentially parallel to the shaft 16. The correction wheel 17 is equipped with a coaxial bearing journal 33 entering the passage bore 32, with the free frontal end of such journal being in a form of a point and serving as a height control key 28 in contact with the setting shaft 16.

The correction wheel 17 is located within a recess 34 coaxially surrounding the passage bore 32 in the block 3 and is dimensioned so that its teeth 35 always engage the teeth 36 of the intermediate gear 24, independently of the instantaneous position of the shaft 16. The intermediate gear penetrates through the slot 25 into the peripheral area of the recess 34 to acommodate engagement with the teeth of the correction wheel.

The correction wheel 17 is pressured by a leaf-spring 37 (which may be spirally shaped) into the recess 34. Thus, the bearing journal 33 is biased through the passage bore 32 to rest against one of the height control surfaces 27.1, 27.2. The free end 38 of the spring 37 abuts the correction wheel 17 in a recess 39 in the top side of the correction wheel 17 (opposite the journal 33). The spring may be an integrated component of a suitably shaped spring plate 40, which is fastened, for example by means of the screws 41, to the block 3. The setting shaft locking element 22 may also be exposed to the action of a suitably projecting and beveled area of the spring plate 40, or a corresponding arm formed on the spring plate 40 may extend, as shown, as the locking element 22 into the locking groove 21. As shown by a broken line in FIG. 2, a further pressure arm 42 curvingly passing over the correction wheel 17 may be formed onto the spring plate 40, which arm 42 holds the minute wheel 12 on its bearing journal 11 in a defined contact with the block 3.

The spring plate 40 mounted directly above the intermediate gear 24 serves as a radial holding device in the slot 25, if the setting shaft 16 is removed entirely, as during repair work or an assembly operation, for example. The opposing holding function may be effected by a circuit board 51 provided for the electronic circuit (not shown), which is mounted by screws 52 in this area. Preferably, in the operating position of the setting shaft 16 the height control key 28 of the correction wheel 17 rests against the surface 27.1, which as a larger diameter than the adjacent surface 27.2. The correction wheel 17 (FIG. 1) is thereby tilted such that a portion thereof (i.e., a force transmission portion 60 engaging the gear 12), is raised from the bottom 43 of the recess 34 in the block 3. The spring 37 presses against a peripheral area 44 of the correction wheel 17, i.e., against an outer periphery of the recess 39 and in the vicinity of the gearing engagement of the correction wheel 17 with the intermediate gear 24. Because of that, and also the provision of adequate radial clearance for the journal 33 in its passage bore 32, there occurs no lifting of the correction wheel 17. Rather, the correction wheel 17 is tilted obliquely with respect to (i) the bottom 43 of the recess in the block 3, (ii) the longitudinal axis of the shaft 16, and (iii) the wheels of the hands mechanism 5, together with a corresponding inclining of its axle of rotation 45 within the passage bore 32. Thus, while maintaining a continuing gearing engagement with the intermediate gear 36, the correction wheel teeth 35 are raised (as a consequence of the trigonometric conditions in the tilted position) from engagement with the minute wheel 18 and into a gear chamber 46. Such chamber 46 is already in existence as a free, unused space above the block 3 for the operational coupling of the minute hand 12 with the hour wheel 14 and is adjacent to the spring plate 40. In this position of the setting shaft 16, the hands mechanism 5 is driven without entraining the correction wheel 17 in rotation, and torsional motions of the shaft 16 are without effect on the rotating drive and instantaneous position of the minute arbor 7 and the hour tube 15.

By means of the pressure support of the correction wheel 17 in the area of the intermediate gear 24 (approximately diametrically opposite the force transmission area 60, it is assured that no additional structural height must be provided for releasing the correction engagement. It is merely necessary to insure that, due to a slight extension of the gear tooth root of the correction wheel 17, the tilting motion of the correction wheel 17 is effected during engagement with the intermediate gear 36 without jamming.

If the time display by the hands is to be set (adjusted) manually by means of the shaft 16, the latter is pulled into its correction position shown in FIG. 2. In normal operation the stepping motor is now disconnected by means of a electrochemical switching element (not shown) actuated by the shaft 16, possibly by means of the leading ramp 26. During the transition from the operating into the correction position, the height control key 28 of the correction wheel 17 slides from the large diameter surface 27.1 over the leading ramp 26 and onto the small diameter surface 27.2. The latter is dimensioned so that due to the spring pressure, the correction wheel abuts against the bottom 43 of the recess in the block 3, whereupon the teeth 35 of the correction wheel engage the teeth 18 of the minute wheel. This engagement is assured by the spring 37 independently of the spatial position of the clockwork 2. Rotating motion of the shaft 16 is transmitted through the intermediate gear 24 and the correction wheel 17 to the minute gear 12 which, by means of its pinion 10, rotates the minute gear 6 and, by means of the minute wheel pinion 13, rotates the hour wheel 14.

Upon the return of the shaft 16 into its depressed position, i.e., into the watch operating position (FIG. 1), the height control key 28 is again raised along the leading ramp 26 and the correction wheel 17 is again tilted, so that it is lifted away from its engagement with the minute wheel 12.

Figure 3:
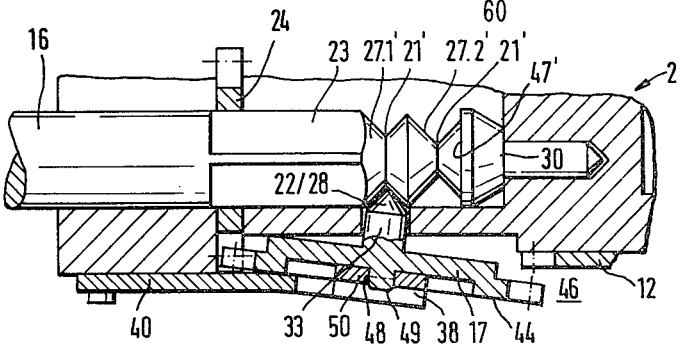
FIG. 3 is a view similar to FIG. 1 depicting another preferred embodiment of a setting shaft engagement mechanism.
Figure 4:
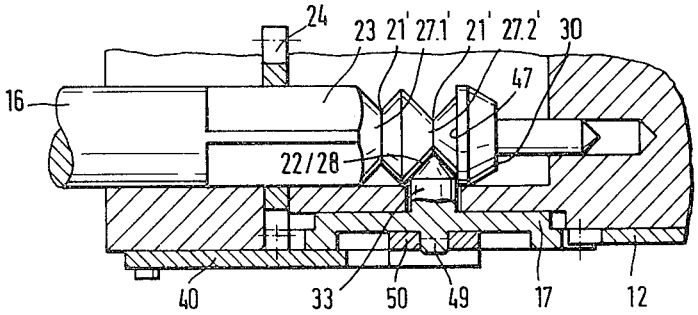
FIG. 4 is a view similar to FIG. 2 of the second embodiment.

A modified embodiment according to FIGS. 3 and 4 differs from that of FIGS. 1 and 2 in particular in that the setting shaft locking grooves 21' for both of the functional positions of the shaft are placed in the area of the height control surfaces 27.1', 27.2'. The height control key 28 is thereby able to perform additionally the function of the previously used locking element 22. A counterstop 47' for the limiting of the axial traction motion of the shaft is again provided as the axial boundary of the associated groove 21', i.e., in the form of a stop collar that cannot be overcome by the key 28 in the axial direction of the setting shaft 16.

In order to enhance the shaft locking action of the pointed key 28 connected with the correction wheel 17, an opening or recess 48 is provided in the area of the free end 38 of the spring. This recess 48 is engaged by a guide pin 49 formed on the correction wheel 17 for the sole means of axial and radial guidance of the wheel 17. This recess may be provided directly in the end 38 of the spiral spring; it is, however, more appropriate to fasten an annular disk 50 to the end 38 of the spiral spring, to serve as a bearing as shown in FIGS. 3 and 4.

The lifting of the correction wheel 17 from its gearing engagement with the minute wheel 12 in the operating position of the shaft 16 (FIG. 3) is again effected by means of height control. However, as noted earlier, such height control does not require additional space in the clockwork 2 for raising of the complete correction wheel 17, because there occurs only a tilting of the correction wheel 17 and a displacement of only the force-transmission area which is at the already-existing free space of the gear chamber 46.

Although the present invention has been described in connection with preferred embodiments thereof, it will be appreciated by those skilled in the art that additions, modifications, substitutions, and deletions not specifically described, may be made without departing from the spirit and scope of the invention, as defined in the appended claims.

What is claimed is:

1. In an electronic wristwatch in which a rotatable correction wheel is moved into and from operative geared connection with a hands mechanism by means of an axially slidable setting shaft to determine the positioning of said correction wheel as a function of the axial placement of said shaft, the improvement comprising means mounting said correction wheel for tilting movement such that the axis of rotation of said wheel is inclined in a manner moving a force transmission portion of said wheel into and out of said geared connection with the hands mechanism in a direction generally parallel to the hands axis.

2. Apparatus according to claim 1, wherein said wheel includes a central bearing journal, said mounting means comprising a mounting block having an aperture within which said bearing journal is disposed, a spring arranged to bias said bearing journal against said shaft, said shaft having axially spaced control surfaces of different radial height to determine the position of said bearing journal and said force transmission portion of said wheel, an intermediate gear arranged for being rotated by said shaft, said intermediate gear being operably connected to said correction wheel at a drive location diametrically opposite said force transmission portion of the correction wheel, said aperture receiving said bearing journal for relative play to enable said correction wheel to tilt generally about said drive location as a fulcrum.

3. Apparatus according to claim 2, wherein said spring comprises a leaf-spring anchored to said mounting block.

4. Apparatus according to claim 3, wherein said intermediate gear is seated on said shaft and is disposed in a slot of said mounting block which prevents movement of said intermediate gear in the axial direction of said shaft, said shaft being slidable in said axial direction relative to said intermediate gear, said intermediate gear being retained against lateral movement by a circuit board on one side and said spring on another side.

5. Apparatus according to claim 3, including spring means for releasably retaining said shaft in a plurality of axial positions.

6. Apparatus according to claim 5, wherein said control surfaces of said shaft constitute portions of axially spaced locking grooves, said bearing journal engaging said locking grooves to releasably retain said shaft in said axial positions, said spring means being defined by said leaf-spring.

7. Apparatus according to claim 6, wherein said leaf-spring is arranged to constitute the sole support for said correction wheel in the axial and radial directions of the latter.

8. Apparatus according to claim 1, wherein a portion of said wheel disposed opposite said force transmission portion defines a fulcrum about which said wheel tilts.

9. Apparatus according to claim 1, wherein said hands mechanism includes a gear defining a chamber, said force transmission portion of said correction wheel traveling into said chamber upon tilting of said correction wheel out of connection with said hands mechanism.

* * * * *